US010068522B2

(12) United States Patent
Huang et al.

(10) Patent No.: US 10,068,522 B2
(45) Date of Patent: Sep. 4, 2018

(54) METHOD OF DRIVING DUAL PIXEL OF ACTIVE MATRIX ORGANIC LIGHTING EMITTING DIODE DISPLAY

(71) Applicant: Chunghwa Picture Tubes, LTD., Taoyuan (TW)

(72) Inventors: Yen-Yu Huang, Taoyuan (TW); Chin-Hai Huang, Taoyuan (TW); Chi-Chung Tsai, Kinmen County (TW); Szu-Chi Huang, Changhua County (TW)

(73) Assignee: Chunghwa Picture Tubes, LTD., Taoyuan (TW)

( * ) Notice: Subject to any disclaimer, the term of this patent is extended or adjusted under 35 U.S.C. 154(b) by 0 days.

(21) Appl. No.: 15/667,620

(22) Filed: Aug. 2, 2017

(65) Prior Publication Data

US 2017/0330510 A1 Nov. 16, 2017

Related U.S. Application Data

(63) Continuation of application No. 14/831,134, filed on Aug. 20, 2015, now Pat. No. 9,761,171.

(51) Int. Cl.
*G09G 3/3233* (2016.01)
*G09G 3/3225* (2016.01)

(52) U.S. Cl.
CPC ..... *G09G 3/3225* (2013.01); *G09G 3/3233* (2013.01); *G09G 2300/0426* (2013.01); *G09G 2300/0443* (2013.01); *G09G 2300/0452* (2013.01); *G09G 2300/0465* (2013.01); *G09G 2300/0842* (2013.01); *G09G 2330/021* (2013.01)

(58) Field of Classification Search
CPC ..... G09G 2330/021; G09G 2300/0452; G09G 2300/0426; G09G 3/32; G09G 3/3208; G09G 3/3233; G09G 3/3607; G09G 2300/0443
See application file for complete search history.

(56) References Cited

U.S. PATENT DOCUMENTS 8,334,859 B2 * 12/2012 Liu ..... G09G 3/2003 315/169.3
9,129,570 B2 * 9/2015 Cho ..... G09G 3/3607
2011/0063260 A1 * 3/2011 Wang ..... G09G 3/3677 345/204
2012/0147065 A1 * 6/2012 Byun ..... G09G 3/3208 345/690
2012/0182489 A1 * 7/2012 Wang ..... G02F 1/1368 349/38
2014/0210868 A1 * 7/2014 Cho ..... G09G 3/3648 345/690

(Continued)

*Primary Examiner* — Antonio Xavier
(74) *Attorney, Agent, or Firm* — JCIPRNET

(57) ABSTRACT

A pixel array includes a plurality of pixels. Each pixel has a first sub-pixel, a second sub-pixel, and a pair of third sub-pixels. The first sub-pixel of each pixel and the first sub-pixels of three adjacent pixels are arranged in a two by two array, the second sub-pixel of each pixel and the second sub-pixels of three adjacent pixels are arranged in a two by two array, and one of each of the third sub-pixels of each pixel and one of the third sub-pixels of three adjacent pixels are arranged in a two by two array. A scan line is connected to a switch unit of each of the sub-pixels in a pixel.

6 Claims, 4 Drawing Sheets

(56) References Cited

U.S. PATENT DOCUMENTS

| | | | | |
|---|---|---|---|---|
| 2015/0187272 | A1* | 7/2015 | Kimura | G09G 3/3258<br>345/694 |
| 2016/0240593 | A1* | 8/2016 | Gu | G09G 3/3225 |

* cited by examiner

METHOD OF DRIVING DUAL PIXEL OF ACTIVE MATRIX ORGANIC LIGHTING EMITTING DIODE DISPLAY

CROSS-REFERENCE TO RELATED APPLICATION

This application is a continuation application of and claims the priority benefit of U.S. application Ser. No. 14/831,134, filed on Aug. 20, 2015, now allowed. The entirety of the above-mentioned patent applications is hereby incorporated by reference herein and made a part of specification.

BACKGROUND OF THE INVENTION

1. Field of the Invention

The present invention generally relates to a pixel array of an active matrix organic lighting emitting display and a method of driving the same.

2. Description of Related Art

Active matrix organic light emitting diode displays, which have the advantages of absence of color filter, self-luminescence and low power consumption, is always viewed as the best candidate to substitute for the liquid crystal display and become the main display technology of the next generation.

In a conventional active matrix organic light emitting diode display, a pixel array has multiple pixels. Each pixel has a blue sub-pixel, a green sub-pixel, and a red sub-pixel. In the fabrication stage of the organic light emitting display of an active matrix organic light emitting display device, evaporation deposition process is used to fabricate the pixel array. A fine metal mask including vertical stripe openings is used for manufacturing the conventional organic light emitting diode display through an evaporation process of organic light emitting materials. The blue, green, and red sub-pixels are formed on a substrate by the evaporation process sequentially through the masks for each sub-pixel. This type of mask will form pixels composed of a blue sub-pixel, a green sub-pixel, and a red sub-pixel disposed adjacently along a horizontal direction. The evaporation process with conventional masks requires high precision. This is so-called a stripe type pixel arrangement.

Furthermore, in this conventional pixel array, a specific distance between the stripe openings is required for maintaining sufficient structural strength of the mask to avoid yield loss of the pixel array caused by process variations and low aligning precision of the manufacturing process. However, the distance between the stripe openings has to be shrunk for higher resolution demand about the pixel array. Therefore, the stripe openings in the fine metal mask (FMM) are physically limited. Problems such as complicated manufacturing process of the fine metal masks and worse stability of the organic light emitting material may become serious accordingly. In addition, the restrictions of the openings in the conventional fine metal masks will restrict the display quality of the active matrix organic light emitting diode display.

SUMMARY OF THE INVENTION

The invention is directed to a pixel array of an active matrix organic light emitting diode (OLED) display including a plurality of pixels. The pixels are arranged in an array. Each pixel is electrically connected with a scan line, a first data line, a second data line, a third data line between the first data line and the second data line, and a power source. The scan line is intersected with the first data line, the second data line and the third data line. Each pixel includes a first sub-pixel, a second sub-pixel and a pair of third sub-pixels. A first OLED of the first sub-pixel is electrically connected to the scan line, the first data line and the power source through a first driving circuit of the first sub-pixel. A second OLED of the second sub-pixel is electrically connected to the scan line, the second data line and the power source through a second driving circuit of the second sub-pixel. A third OLED of each third sub-pixel is electrically connected to the scan line, the third data line and the power source through a third driving circuit of the corresponding third sub-pixel. The first sub-pixel, the second sub-pixel, and the third sub-pixels in each pixel are arranged in a two by two array. The pair of third sub-pixels are arranged diagonally to each other, and the first sub-pixel and the second sub-pixel are arranged diagonally to each other. The first sub-pixel of each pixel and the first sub-pixels of three adjacent pixels are arranged in a two by two array, the second sub-pixel of each pixel and the second sub-pixels of three adjacent pixels are arranged in a two by two array, and one of each of the third sub-pixels of each pixel and one of the third sub-pixels of three adjacent pixels are arranged in a two by two array.

According to an embodiment of the invention, the first OLED emits a green light.

According to an embodiment of the invention, the second OLED emits a red light.

According to an embodiment of the invention, the third OLED emits a blue light.

According to an embodiment of the invention, each of the first driving circuit, the second driving circuit, and the third driving circuit includes a switch unit, a driving unit, and at least one capacitor electrically connected between the switch unit and the driving unit.

According to an embodiment of the invention, a method of driving each of the pixels in the pixel array includes writing data respectively to the first sub-pixel through the first data line, the second sub-pixel from the second data line, and the third sub-pixel through the third data line when an enabling signal is applied to the scan line.

The invention is directed to another pixel array of an active matrix organic light emitting diode (OLED) display including a plurality of pixels. The pixels are arranged in an array. Each pixel is electrically connected with a scan line, a first data line, a second data line, a third data line between the first data line and the second data line, and two power lines. The scan line is intersected with the first data line, the second data line and the third data line. The power lines and the data lines are parallel and alternately arranged. Each pixel includes a plurality of sub-pixels respectively as a first sub-pixel, a second sub-pixel, and a pair of third sub-pixels. The scan line is connected to a switch unit of each of the sub-pixels, the switch unit of the first sub-pixel is connected to the first data line, the switch unit of the second sub-pixel is connected to the second data line, and the switch units of the pair of third sub-pixels are connected to the third data line. Each power line is connected to the driving units of two sub-pixels in a same column of each pixel, and an OLED of each of the sub-pixels are electrically connected to the driving unit of each of the sub-pixels. The first sub-pixel, the second sub-pixel, and the third sub-pixels in each pixel are arranged in a two by two array, the pair of third sub-pixels are arranged diagonally to each other, and the first sub-pixel and the second sub-pixel are arranged diagonally to each other. The first sub-pixel of each pixel and the first sub-pixels of the three adjacent pixels are arranged in a two by two array, the second sub-pixel of each pixel and the second sub-pixels of the three adjacent pixels are arranged in a two by two may, and one of each of the third sub-pixels of each pixel and one of the third sub-pixels of the three adjacent pixels are arranged in a two by two array.

According to an embodiment of the invention, the OLED of the first sub-pixel emits a green light.

According to an embodiment of the invention, the OLED of the second sub-pixel emits a red light.

According to an embodiment of the invention, the OLED of the third sub-pixel emits a blue light.

According to an embodiment of the invention, each pixel further includes a capacitor electrically connected between the switch unit and the driving unit.

According to an embodiment of the invention, a method of driving each of the pixels in the pixel array includes writing data respectively to the first sub-pixel through the first data line, the second sub-pixel through the second data line, and the third sub-pixels through the third data line when an enabling signal is applied to the scan line.

The invention also provides a method of driving a dual pixel of an active matrix organic light emitting diode display. The dual pixel includes a first sub-pixel, a second sub-pixel, and a pair of third sub-pixels arranged in a two by two array. The dual pixel is electrically connected to a first scan line, a second scan line, a first data line, and a second data line. The dual pixel serves as two pixels, and each pixel includes the first sub-pixel, the second sub-pixel, and one of the third sub-pixels, and the first sub-pixel and the second sub-pixel are shared between the two pixels. When an enabling signal is applied to the first scan line, data is respectively written to the first sub-pixel in a first row of the dual pixel through the first data line and one of the third sub-pixels in the first row through the second data line. When an enabling signal is applied to the second scan line, data is respectively written to the other one of the third sub-pixels in a second row of the dual pixel through the first data line and the second sub-pixel in the second row through the second data line. When data is written into the first sub-pixel and the second sub-pixel, the first sub-pixel and the second sub-pixel act as sub-pixels for two independent pixels.

In summary, the pixels form a two by two array with a first sub-pixel, a second sub-pixel and a pair of third sub-pixels. The pixel array is formed through an arrangement of the same sub-pixels in a two by two array. In such a way, masks used to fabricate the pixel array can have large openings. This improves the fabrication yield and stability of the masks, and the resolution of the fabricated active matrix organic light emitting diode display can be high.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
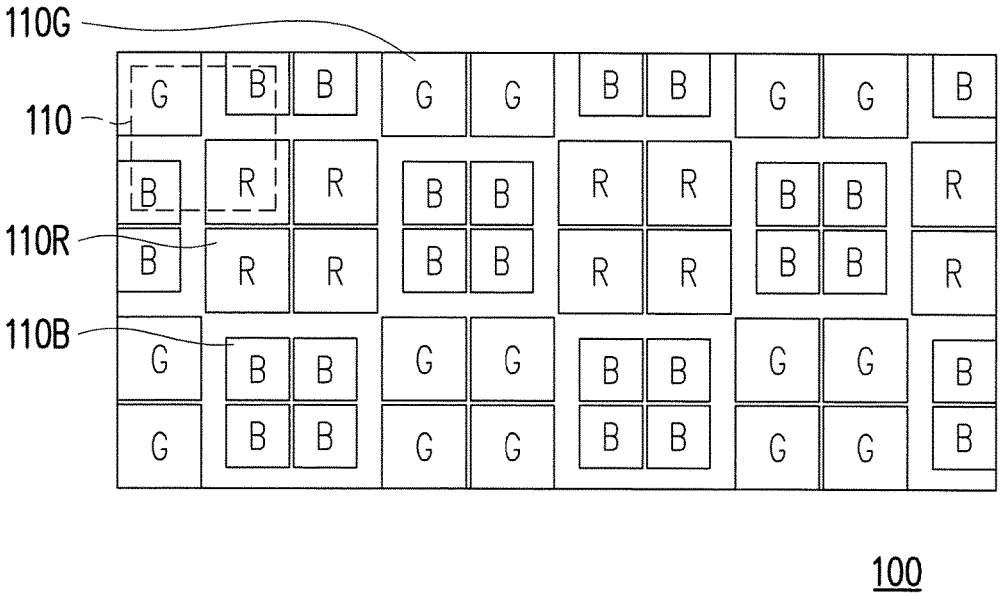
FIG. 1 is a schematic diagram of a pixel array of an active matrix organic light emitting diode display according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
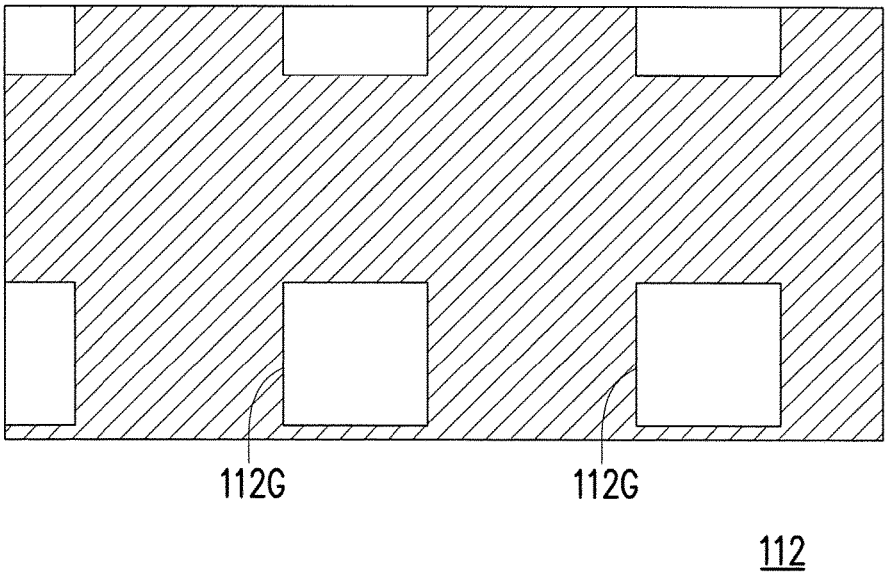
FIGS. 2-4 are schematic diagrams of masks utilized to fabricate the pixel array of FIG. 1.
Figure 3:
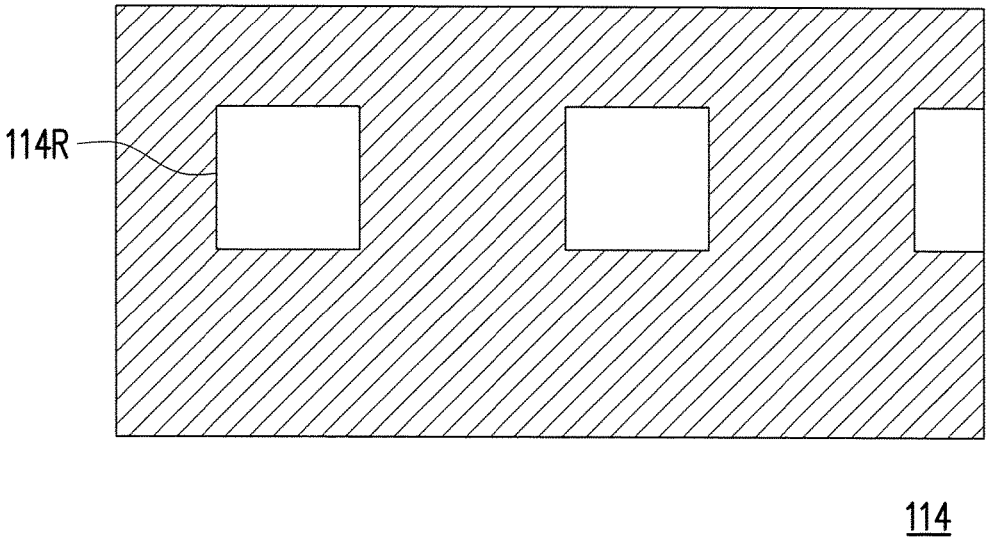
Figure 4:
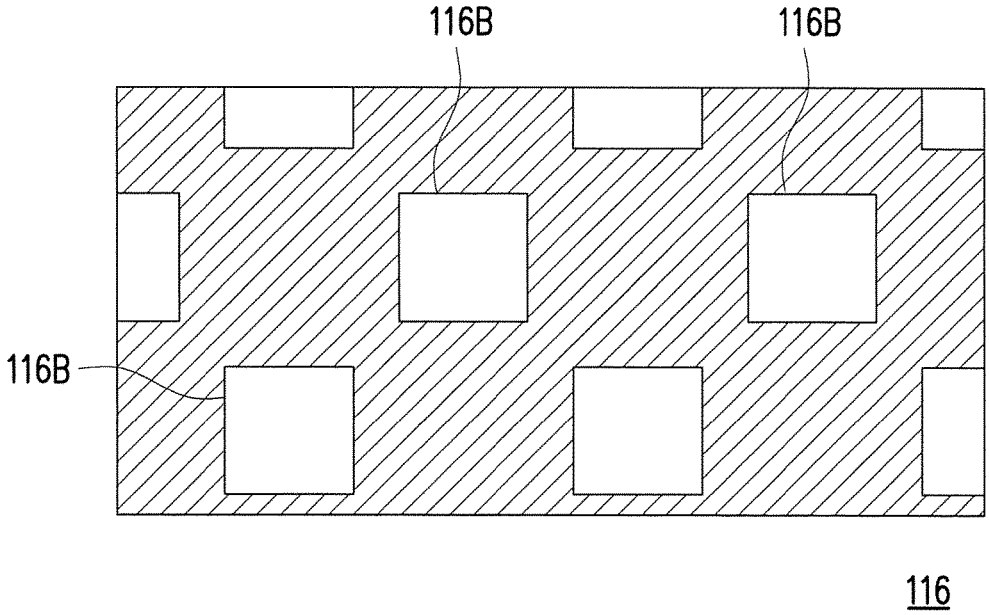

FIG. 1 is a schematic diagram of a pixel array of an active matrix organic light emitting diode display according to an embodiment of the invention. FIGS. 2-4 are schematic diagrams of masks utilized to fabricate the pixel array of FIG. 1. Referring to FIG. 1, the pixel array 100 includes a plurality of pixels 110 arranged in an array. Each of the pixels 110 includes a first sub-pixel 110G, a second sub-pixel 110R, and a pair of third sub-pixels 110B.

The first sub-pixel 110G, the second sub-pixel 110R, and the third sub-pixels 110B in each pixel 110 are arranged in a two by two may. The pair of third sub-pixels 110B are arranged diagonally to each other, and the first sub-pixel 110G and the second sub-pixel 110R are arranged diagonally to each other. The first sub-pixel 110G of each pixel 110 is adjacent to the first sub-pixels 110G of three adjacent pixels 110. The second sub-pixel 110R of each pixel 110 is adjacent to the second sub-pixels 110R of three adjacent pixels 110, and each third sub-pixel 110B of each pixel 110 is adjacent to one of the third sub-pixels 110B of three adjacent pixels 110.

The first sub-pixel 110G of each pixel 110 and the first sub-pixels 110G of the three adjacent pixels 110 are arranged in a two by two array. The second sub-pixel 110R of each pixel 110 and the second sub-pixels 110R of the three adjacent pixels 110 are arranged in a two by two array. One of each of the third sub-pixels 110B of each pixel 110 and one of the third sub-pixels 110B of the three adjacent pixels 110 are arranged in a two by two array.

FIGS. 2-4 are schematic diagrams of masks utilized to fabricate the pixel array of FIG. 1. The pixel array 100 of the active matrix organic light emitting diode display utilizes an evaporation deposition process with the masks having different opening patterns to fabricate the first sub-pixels 110G, the second sub-pixels 110R, and the third sub-pixels 110B, respectively. The pixel array 100 of FIG. 2 shows a first mask 112 with a plurality of first openings 112G corresponding to the first sub-pixels 110G. FIG. 3 shows a second mask 114 with a plurality of second openings 114R corresponding to the second sub-pixels 114R. FIG. 4 shows a third mask 116 with a plurality of third openings 116B corresponding to the third sub-pixels 110B.

Arrangements of openings in the first mask 112, the second mask 114, and the third mask 116 are similar, a difference being that the arrangement of openings in each mask is offset from the arrangement of openings in each other mask. In addition, the size of the openings can be adjusted and varied according to need. By utilizing the first mask 112, the second mask 114, and the third mask 116 in order in the evaporation deposition process, the pixel array shown in FIG. 1 can be fabricated. Each opening of each mask utilizes the evaporation deposition process to fabricate four of the same sub-pixels. That is to say, each of the first openings 112G form four first sub-pixels 110G, each of the second openings 114R form four second sub-pixels 110R, and each of the third openings 116B form four third sub-pixels 110B.

In such a way, the masks can have large openings. Thus, the precision required during the fabrication process is not as demanding. Even with low precision during the fabrication process, the resolution of the fabricated active matrix organic light emitting diode display can be high. This improves the fabrication yield and stability of the masks.

Figure 5:
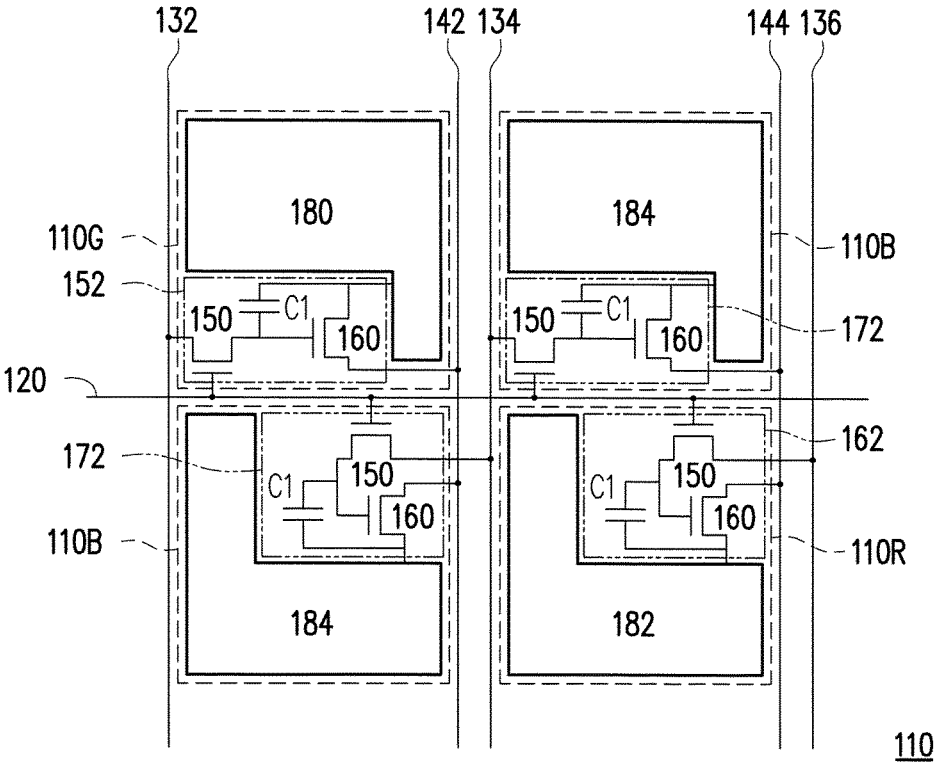
FIG. 5 is a schematic diagram of a pixel of the pixel array of FIG. 1.

FIG. 5 is a schematic diagram of a pixel of the pixel array of FIG. 1. Referring to FIG. 5, each of the sub-pixels 110G, 110R, 110B in the pixel 110 includes a driving circuit (a first driving circuit 152, a second driving circuit 162, a third driving circuit 172), and an organic light emitting diode (OLED) (a first OLED 180, a second OLED 182, a third OLED 184). The first OLED 180 of the first sub-pixel 110G emits a green light. Thereby, the first sub-pixel 110G is a green sub-pixel. The second OLED 182 of the second sub-pixel 110R emits a red light. Thereby, the second sub-pixel 110R is a red sub-pixel. The third OLED 184 of the third sub-pixel 110B emits a blue light. Thereby, the third sub-pixel 110B is a blue sub-pixel. Each of the driving circuits 152, 162, 172 includes at least two transistors. In the embodiment, each of the driving circuits 152, 162, 172 include a switch unit 150 and a driving unit 160.

The pixels 110 are electrically connected with a scan line 120, a first data line 132, a second data line 136, a third data line 134 between the first data line 132 and the second data line 136, a first power line 142, and a second power line 144. The power lines (the first power line 142, the second power line 144) of the pixel array 100 can be connected to a power source, and serve as a power source. The scan line 120 is intersected with the first data line 132, the second data line 136 and the third data line 134 to form a two by two array of each pixel 110.

Specifically, the scan line 120 is connected to the switch unit 150 of each of the sub-pixels 110G, 110R, 110B in the pixel 110. The switch unit 150 of the first driving circuit 152 of the first sub-pixel 110G is electrically connected to the first data line 132. The switch unit 150 of the second driving circuit 162 of the second sub-pixel 110R is electrically connected to the second data line 136. The switch units 150 of the third driving circuits 172 of the pair of third sub-pixels 110B are electrically connected to the third data line 134. The first power line 142 is connected to the driving unit 160 of two sub-pixels in the same column of the pixel 110. In the embodiment, for example, the first power line 142 is electrically connected to the driving units 160 of the driving circuit 152 of the first sub-pixel 110G and the driving circuit 172 of one of the third sub-pixels 110B that are in the same column as the first sub-pixel 110G. The second power line 144 is connected to the driving unit 160 of two sub-pixels in the same column of the pixel 110 different from the two sub-pixels connected to the first power line 142. In the embodiment, for example, the second power line 144 is electrically connected to the driving units 160 of the second driving circuit 162 of the second sub-pixel 110R and the third driving circuit 172 of the other one of the third sub-pixels 110B that are in the same column as the second sub-pixel 110R.

The first OLED 180 of the first sub-pixel 110G is electrically connected to the scan line 120, the first data line 132 and the first power line 142 through the first driving circuit 152 of the first sub-pixel 110G. The second OLED 182 of the second sub-pixel 110R is electrically connected to the scan line 120, the second data line 136 and the second power line 144 through the second driving circuit 162 of the second sub-pixel 110R. The third OLED 184 of each third sub-pixel 110B is electrically connected to the scan line 120 and the third data line 134 through the third driving circuit 172 of the corresponding third sub-pixel 110B. The OLEDs 180, 182, 184 of each sub-pixel 110G, 110R, 110B are electrically connected to the corresponding driving units 160 of the driving circuits 152, 162, 172.

Furthermore, each driving circuit 152, 162, 172 further includes at least one capacitor C1 electrically connected between the switch unit 150 and the driving unit 160. Thus, each driving circuit 152, 162, 172 has, for example, a two transistor one capacitor structure. However, the invention is not limited thereto. Each driving circuit may include additional transistors and capacitors, and have an m transistor n capacitor structure, wherein m is greater than 2, and n is greater than one.

The configuration shown in FIG. 5 is an example of one of the pixels 110 in the pixel array 100. The configuration of other pixels 110 in the pixel array 100 are similar except the positions of the sub-pixels 110G, 110R, 110B may not be exactly the same as the positions of the sub-pixels 110G, 110R, 110B shown in FIG. 5. For example, a pixel below the pixel 110 in the pixel array 100 of FIG. 1 has the first sub-pixel 110G in the bottom left corner, and the second sub-pixel 110R in the top right corner. In the pixel to the right of the pixel 110 in the pixel array 100 of FIG. 1 has the first sub-pixel 110G in the top right corner, and the second sub-pixel 110R in the bottom left corner. The arrangements of the sub-pixels are not limited thereto. However, it should be noted that the two third sub-pixels 110B are diagonal to each other, and the first sub-pixel 110G and the second sub-pixel 110R are diagonal to each other in any configuration. The number of data lines, scan lines, and power lines are not limited to the above description. The number of data lines, scan lines, and power lines depend on the number of pixels 110 in the pixel array 100, and electrically connect the pixels 110 in the pixel array 100 as described above. That is to say, the scan lines connect to the pixels 110 in the same row of the pixel array 100. The data lines and the power lines connect to the pixels 110 in the same column of the pixel array.

With this configuration, it can be seen that the pair of third sub-pixels 110B in the pixel 110 share the third data line 134. The three types of sub-pixels 110G, 110R, 110B have OLEDs 180, 182, 184 of different organic materials. Therefore, the luminous efficiency of the types of sub-pixels 110G, 110R, 110B are different. Sub-pixels with low luminous efficiency require a larger driving unit, and vice versa. Conventionally, the sub-pixels with low luminous efficiency are compensated by increasing the dimensions of the driving unit. The different sizes of the driving units will require a specific ratio for the pixel to achieve white balance. However, in the embodiment, since the luminous efficiency of the third sub-pixel 110B is low, using a same data line for two third sub-pixels 110B that is each powered by a power line in the same pixel 110 can allow the third sub-pixels 110B to not have to increase the dimensions of the driving unit 160. Having two third sub-pixels 110B doubles the amount of light emitted from the third sub-pixels 110B, which can better control white balance without having to increase the size of the driving unit of the third sub-pixels 110B with low luminous efficiency.

To drive the pixel 110, when an enabling signal is applied to the scan line 120, data is written respectively to the first sub-pixel 110G through the first data line 132, the second sub-pixel 110R through the second data line 136, and the third sub-pixels 110B through the third data line 134. This method completes the writing of data into the pixel 110, and achieves a balanced luminous efficiency between the sub-pixels 110G, 110R, 110B in the pixel 110. Also, by adapting a suitable algorithm for driving the pixel array 100, the pixels 110 can achieve high resolution.

Figure 6:
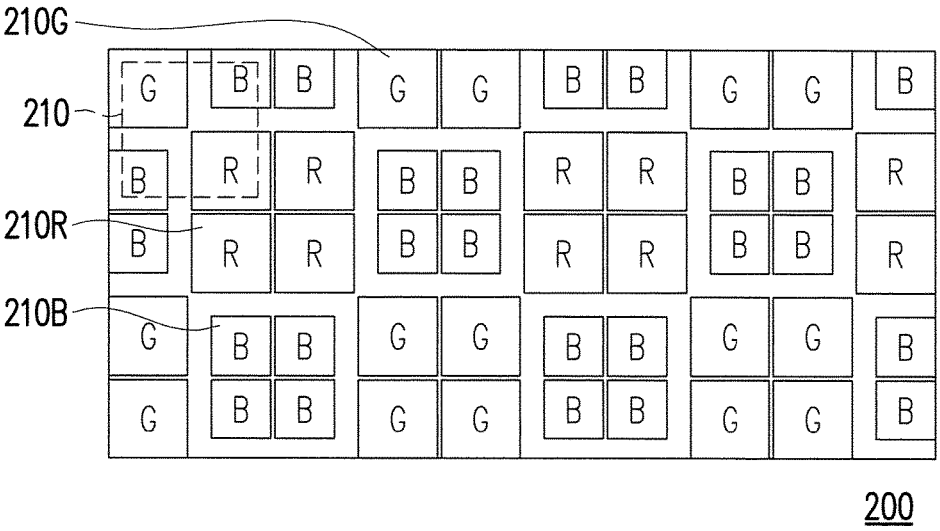
FIG. 6 is a schematic diagram of a pixel array of an active matrix organic light emitting diode display according to another embodiment of the invention.

FIG. 6 is a schematic diagram of a pixel array according to another embodiment of the invention. Referring to FIG. 6, the pixel array includes a plurality of dual pixels 210. Each dual pixel 210 includes a first sub-pixel 210G, a second sub-pixel 210R, and a pair of third sub-pixels 210B arranged in a two by two array. The dual pixel 210 serves as two pixels. Each pixel includes the first sub-pixel 210G, the second sub-pixel 210R, and one of the third sub-pixels 210B. The first sub-pixel 210G and the second sub-pixel 210R are shared between the two pixels in the dual pixel 210. Thus, each pixel in the dual pixel 210 has an "L" shape, which combines through the sharing of the first sub-pixel 210G and the second sub-pixel 210R to form the two by two array of the dual pixel 210.

The method of fabricating the pixel array of FIG. 6 is through the masks in FIGS. 2-4. Therefore, the layout and method of fabricating the pixel array in FIG. 6 is similar to the pixel array 100 in FIG. 1. Detailed description will not be repeated.

Figure 7:
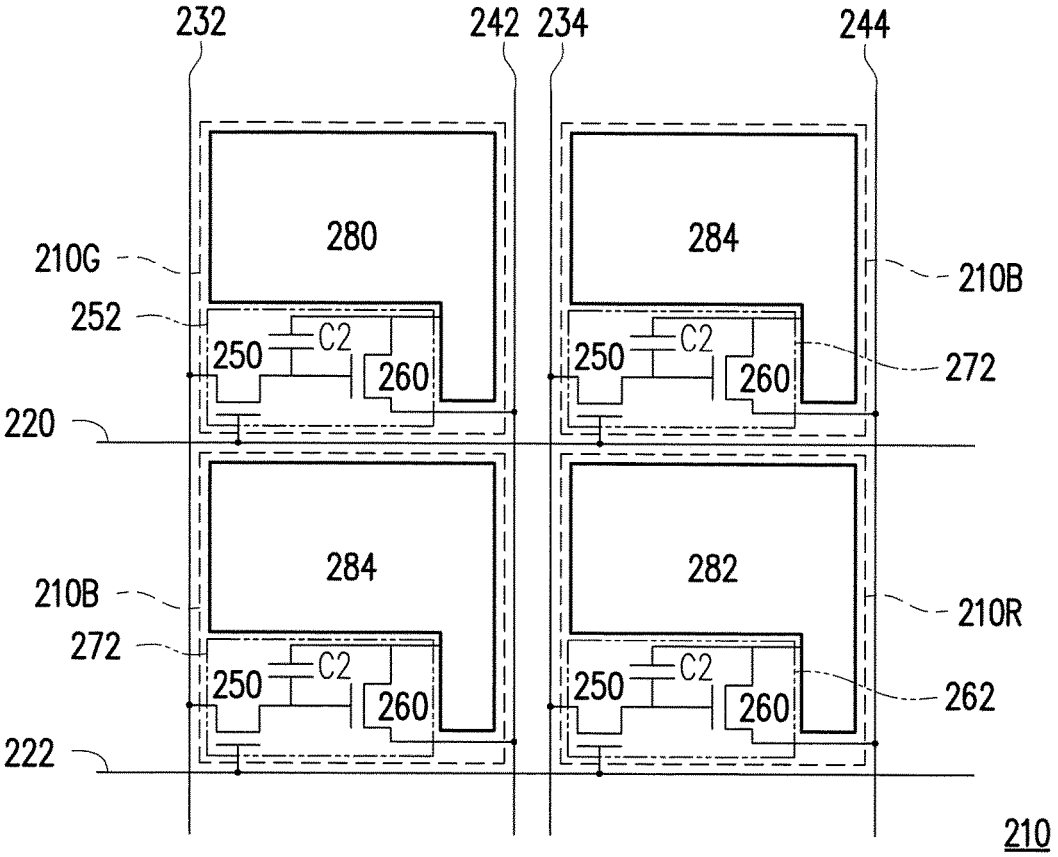
FIG. 7 is a schematic diagram of a dual pixel of the pixel array of FIG. 6.

FIG. 7 is a schematic diagram of a dual pixel of the pixel array of FIG. 6. Referring to FIG. 7, each of the sub-pixels 210G, 210R, 210B in the dual pixel 210 includes a driving circuit (a first driving circuit 252, a second driving circuit 262, a third driving circuit 272), and an organic light emitting diode (OLED) (a first OLED 280, a second OLED 282, a third OLED 284). The first OLED 280 of the first sub-pixel 210G emits a green light. Thereby, the first sub-pixel 210G is a green sub-pixel. The second OLED 282 of the second sub-pixel 210R emits a red light. Thereby, the second sub-pixel 210R is a red sub-pixel. The third OLED 284 of the third sub-pixel 210B emits a blue light. Thereby, the third sub-pixel 210B is a blue sub-pixel. Each of the driving circuits 252, 262, 272 includes at least two transistors. In the embodiment, each of the driving circuits 252, 262, 272 include a switch unit 250 and a driving unit 260.

Referring to FIG. 7, it can be seen that the dual pixels 210 are electrically connected to a first scan line 220, a second scan line 222, a first data line 232, a second data line 234, a first power line 242, and a second power line 244. The two power lines (the first power line 242, the second power line 244) of the pixel array 200 can be connected to a power source, and serve as a power source. The first scan line 220 and the second scan line 222 are intersected with the first data line 232 and the second data line 234 to form a two by two array of each dual pixel 210.

Specifically, the first scan line 220 is electrically connected to the switch unit 250 of the driving circuit 252 of the first sub-pixel 210G and the switch unit 250 of the third driving circuit 272 of the third sub-pixel 210B in the same row as the first sub-pixel 210G. The second scan line 222 is electrically connected to the switch unit 250 of the second driving circuit 262 of the second sub-pixel 210R and the switch unit 250 of the third driving circuit 272 of the third sub-pixel 210B in the same row as the second sub-pixel 210R. The first data line 232 is electrically connected to the switch unit 250 of the first driving circuit 252 of the first sub-pixel 210G and the switch unit 250 of the third driving circuit 272 of the third sub-pixel 210B in the same column as the first sub-pixel 210G. The second data line 234 is electrically connected to the switch unit 250 of the second driving circuit 262 of the second sub-pixel 210R and the switch unit 250 of the third driving circuit 272 of the third sub-pixel 210B in the same column as the second sub-pixel 210R. The first power line 242 is connected to the driving unit 260 of the driving circuits of two sub-pixels in the same column of the dual pixel 210. In the embodiment, for example, the first power line 242 is electrically connected to the driving units 260 of the first driving circuit 252 of the first sub-pixel 210G and the third driving circuit 272 of one of the third sub-pixels 210B that are in the same column as the first sub-pixel 210G. The second power line 244 is connected to the driving unit 260 of the driving circuits of two sub-pixels in the same column of the dual pixel 210 different from the two sub-pixels connected to the first power line 242. In the embodiment, for example, the second power line 244 is electrically connected to the driving units 260 of the second driving circuit 262 of the second sub-pixel 210R and the third driving circuit 272 of the other one of the third sub-pixels 210B that are in the same column as the second sub-pixel 210R.

In the embodiment, the first OLED 280 of the first sub-pixel 210G is electrically connected to the first scan line 220, the first data line 232 and the first power line 242 through the first driving circuit 252 of the first sub-pixel 210G. The second OLED 282 of the second sub-pixel 210R is electrically connected to the second scan line 222, the second data line 234 and the second power line 244 through the second driving circuit 262 of the second sub-pixel 210R. The third OLED 284 of one of the third sub-pixels 110B is electrically connected to the first scan line 220, the second data line 234, and the second power line 244 through the third driving circuit 272 of the third sub-pixel 210B in the same row as the first sub-pixel 210G. The third OLED 284 of the other one of the third sub-pixels 210B is electrically connected to the second scan line 222, the first data line 232, and the first power line 242 through the third driving circuit 272 of the third sub-pixel 210B in the same row as the second sub-pixel 210R. The OLEDs 280, 282, 284 of each sub-pixel 210G, 210R, 210B are electrically connected to the corresponding driving units 260 of the driving circuits 252, 262, 272. The configuration described above changes as the location of the sub-pixels 210G, 210B, 210R are varied for different dual pixels 210.

Furthermore, each driving circuit 252, 262, 272 further includes at least one capacitor C2 electrically connected between the switch unit 250 and the driving unit 260. Thus, each driving circuit 252, 262, 272 has, for example, a two transistor one capacitor structure. However, the invention is not limited thereto. Each driving circuit may include additional transistors and capacitors, and have an m transistor n capacitor structure, wherein m is greater than 2, and n is greater than one.

The configuration shown in FIG. 7 is an example of one of the dual pixels 210 in the pixel array 200. The configuration of other dual pixels 210 in the pixel array 200 are similar except the positions of the sub-pixels 210G, 210R, 210B may not be exactly the same as the positions of the sub-pixels 210G, 210R, 210B shown in FIG. 7. For example, a dual pixel below the dual pixel 210 in the pixel array 200 of FIG. 7 has the first sub-pixel 210G in the bottom left corner, and the second sub-pixel 210R in the top right corner. In the pixel to the right of the pixel 110 in the pixel array 200 of FIG. 7 has the first sub-pixel 210G in the top right corner, and the second sub-pixel 210R in the bottom left corner. The arrangements of the sub-pixels are not limited thereto. However, it should be noted that the two third sub-pixels 210B are diagonal to each other, and the first sub-pixel 210G and the second sub-pixel 210R are diagonal to each other in any configuration. The number of data lines, scan lines, and power lines are not limited to the above description. The number of data lines, scan lines, and power lines depend on the number of dual pixels 210 in the pixel array 200, and electrically connect the dual pixels 210 in the pixel array 200 as described above. That is to say, the scan lines connect to the dual pixels 210 in the same row of the pixel array 200. The data lines and the power lines connect to the dual pixels 210 in the same column of the pixel array 200.

To drive the dual pixel 210, when an enabling signal is applied to the first scan line 220, data is written respectively to the first sub-pixel 210G in a first row of the dual pixel 210 through the first data line 232 and one of the third sub-pixels 210B in the first row through the second data line 234. When an enabling signal is applied to the second scan line 222, data is written respectively to the other one of the third sub-pixels 210B in a second row of the dual pixel 210 through the first data line 232 and the second sub-pixel 210R in the second row through the second data line 234. When data is written into the first sub-pixel 210G and the second sub-pixel 210R, the first sub-pixel 210G and the second sub-pixel 210R act as sub-pixels for two independent pixels. Each independent pixel is, for example, the first sub-pixel 210G, the second sub-pixel 210R, and one of the third sub-pixels 210B. The other independent pixel is, for example, the first sub-pixel 210G, the second sub-pixel 210R, and the other one of the third sub-pixels 210B. The dual pixel 210 can achieve the effects of two independent pixels. By adapting a suitable algorithm for driving the pixel array 200, the dual pixels 210 can achieve high resolution comparable to the resolution of two independent pixels. The dual pixels 210 can also display the display data of two independent pixels. In particular, the suitable algorithm calculates the data that is to be written into the first sub-pixel 210G and the second sub-pixel 210R. The data may be, for example, a driving voltage representing the grayscale of one of the sub-pixels. The suitable algorithm calculates, for example, the grayscales of the first sub-pixel 210G and the second sub-pixel 210R according to the two independent pixels simulated by the dual pixel 210. That is to say, the first sub-pixel 210G acts as, for example, two green sub-pixels for two independent pixels, and the second sub-pixel 210R acts as, for example, two red sub-pixels for two independent pixels. Thus, the suitable algorithm must calculate the data written into each of the first sub-pixel 210G and the second sub-pixel 210R in order for the dual pixel 210 to effectively simulate the effects of two independent pixels.

This way, after the dual pixel 210 is driven, the visual effects of the dual pixel 210 will be similar to the visual effects of two independent pixels. For example, the visual effect to the naked eye of the dual pixel 210 will be similar to the visual effect to the naked eye of two independent pixels adjacent to each other. The resolution of the dual pixel 210 will also be similar to the resolution of two independent pixels. In addition, since a conventional independent has three sub-pixels, two conventional independent pixels have six sub-pixels. However, the dual pixel 210 has four sub-pixels, and can achieve similar resolution and visual effects as two conventional independent pixels with six sub-pixels. Therefore, a display panel with the dual pixel 210 of the embodiment can achieve similar resolution and visual effects with smaller dimensions than a display panel with conventional pixels.

In summary, the pixels form a two by two array with a first sub-pixel, a second sub-pixel and a pair of third sub-pixels. The pixel array is formed through an arrangement of the same sub-pixels in a two by two array. In such a way, the masks for fabricating the pixel array can have large openings. Thus, the precision required during the fabrication process is not as demanding. Even with low precision during the fabrication process, the resolution of the fabricated an active matrix organic light emitting diode display can be high. This improves the fabrication yield and stability of the masks. That is to say, the arrangement of the pixel array allows the mask to have large openings. Therefore, the display quality of the active matrix organic light emitting diode display can have higher resolution compared with conventional fine metal masks (FMM). In addition, by adapting a suitable algorithm for driving the pixel array, high resolution can be achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of driving a dual pixel of an active matrix organic light emitting diode (OLED) display, wherein the dual pixel comprises a first sub-pixel, a second sub-pixel, and a pair of third sub-pixels arranged in a two by two array, wherein the dual pixel is electrically connected to a first scan line, a second scan line, a first data line, and a second data line, wherein the dual pixel serves as two pixels, and each pixel comprises the first sub-pixel, the second sub-pixel, and one of the third sub-pixels, and the first sub-pixel and the second sub-pixel are shared between the two pixels, the method comprising:

writing data respectively to the first sub-pixel in a first row of the dual pixel through the first data line and one of the third sub-pixels in the first row through the second data line when an enabling signal is applied to the first scan line; and writing data respectively to the other one of the third sub-pixels in a second row of the dual pixel through the first data line and the second sub-pixel in the second row through the second data line when an enabling signal is applied to the second scan line, wherein when data is written into the first sub-pixel and the second sub-pixel, the first sub-pixel and the second sub-pixel act as sub-pixels for two independent pixels.

2. The method of driving a dual pixel of an active matrix organic light emitting diode (OLED) display as claimed in claim 1, wherein a first OLED of the first sub-pixel emits a green light.

3. The method of driving a dual pixel of an active matrix organic light emitting diode (OLED) display as claimed in claim 1, wherein a second OLED of the second sub-pixel emits a red light.

4. The method of driving a dual pixel of an active matrix organic light emitting diode (OLED) display as claimed in claim 1, wherein a third OLED of each of the third sub-pixel emits a blue light.

5. The method of driving a dual pixel of an active matrix organic light emitting diode (OLED) display as claimed in claim 1, wherein each of the first sub-pixel, the second sub-pixel and the pair of third sub-pixels comprises a switch unit, a driving unit, and at least one capacitor electrically connected between the switch unit and the driving unit.

6. The method of driving a dual pixel of an active matrix organic light emitting diode (OLED) display as claimed in claim 1, wherein the pair of third sub-pixels are diagonal to each other, and the first sub-pixel and the second sub-pixel are diagonal to each other in any configuration.

* * * * *